US008590323B2

(12) United States Patent
Tsukamoto et al.

(10) Patent No.: US 8,590,323 B2
(45) Date of Patent: Nov. 26, 2013

(54) TURBO COMPRESSOR AND REFRIGERATOR

(75) Inventors: Minoru Tsukamoto, Yokohama (JP); Kentarou Oda, Yokohama (JP)

(73) Assignee: IHI Corporation (JP)

( * ) Notice: Subject to any disclaimer, the term of this patent is extended or adjusted under 35 U.S.C. 154(b) by 647 days.

(21) Appl. No.: 12/366,904

(22) Filed: Feb. 6, 2009

(65) Prior Publication Data

US 2009/0193839 A1 Aug. 6, 2009

(30) Foreign Application Priority Data

Feb. 6, 2008 (JP) ..... P2008-027072

(51) Int. Cl.
*F25B 43/02* (2006.01)
*F25B 31/00* (2006.01)
*F04B 17/00* (2006.01)

(52) U.S. Cl.
USPC ..... 62/84; 62/193; 417/366

(58) Field of Classification Search
USPC ..... 62/84, 193, 468, 498; 123/559.1; 184/6.12; 417/366, 372
See application file for complete search history.

(56) References Cited

U.S. PATENT DOCUMENTS 4,404,812 A * 9/1983 Zinsmeyer ..... 62/84
2007/0147984 A1 6/2007 Takahashi et al. ..... 415/100

FOREIGN PATENT DOCUMENTS

| | | | |
|---|---|---|---|
| CN | 2871925 Y | * | 2/2007 |
| JP | 55-87647 | | 6/1980 |
| JP | 56-146095 | | 11/1981 |
| JP | 57-85657 | | 5/1982 |
| JP | S59-25955 | | 2/1984 |
| JP | 59-52185 | | 3/1984 |
| JP | 61-98993 | | 5/1986 |
| JP | 05-018393 | | 1/1993 |
| JP | 5-223092 | | 8/1993 |
| JP | 05-300694 | | 11/1993 |
| JP | 6-173858 | | 6/1994 |
| JP | 2003-021065 | | 1/2003 |
| JP | 2003-214380 | | 7/2003 |
| JP | 2007-177695 | | 7/2007 |

OTHER PUBLICATIONS

Chinese Office Action dated Jul. 9, 2010 in counterpart Chinese Patent Application No. 200910003836.6 (with English language translation).
Office Action dated May 29, 2012 issued in corresponding Japanese Patent Application No. 2008-027072 with English translation (8 pages).
Japanese Notice of Allowance, dated Nov. 27, 2012, issued in corresponding Japanese Patent Application No. 2008-027072. Total 6 pages, including English Translation.

* cited by examiner

*Primary Examiner* — Chen Wen Jiang
(74) *Attorney, Agent, or Firm* — Ostrolenk Faber LLP

(57) ABSTRACT

A turbo compressor includes a motor, an impeller which is rotationally driven as the rotative power of the motor is transmitted to the impeller, a gear unit which transmits the rotative power of the motor to the impeller, and an oil tank to which lubricant supplied to the gear unit is at least recovered, wherein the oil tank is a portion of a closed space formed by at least one of a motor housing surrounding the motor and an impeller housing surrounding the impeller.

13 Claims, 6 Drawing Sheets

TURBO COMPRESSOR AND REFRIGERATOR

BACKGROUND OF THE INVENTION

1. Field of the Invention

The present invention relates to a turbo compressor including a motor and an impeller which is rotationally driven as the rotative power of the motor is transmitted thereto, and a refrigerator including the turbo compressor.

Priority is claimed on Japanese Patent Application No. 2008-27072, filed Feb. 6, 2008, the content of which is incorporated herein by reference.

2. Description of the Related Art

As refrigerators which cool or freeze objects to be cooled, such as water, a turbo refrigerator or the like including a turbo compressor which compresses and discharges a refrigerant by impellers is known.

The turbo compressor included in such a turbo refrigerator or the like has a configuration in which an impeller or a motor for acquiring the rotative power which rotationally drives the impeller is surrounded by a housing, as shown in Japanese Patent Unexamined Publication No. 2007-177695.

Meanwhile, the turbo compressor needs to supply lubricant to sliding parts, such as a gear unit for transmitting the rotative power of the motor to the impeller, in order to make the operation smooth.

The lubricant supplied to the sliding parts is once recovered to an oil tank provided separately from the housing surrounding the motor or impeller for reuse, and is supplied again to the sliding parts.

However, the oil tank is provided separately from the housing which surrounds the motor or impeller as described above. For this reason, when the turbo compressor is assembled, the process of connecting the oil tank to the housing is required, and thus, the assembling process of the turbo compressor becomes complicated.

Additionally, in the turbo refrigerator or the like, chlorofluocarbon is often used as the refrigerant. Consequently, in order to more reliably prevent leakage of the chlorofluocarbon that is the refrigerant, the inside of the housing is sealed. However, when the oil tank is connected to the housing as described above, securement of sealability becomes difficult since connecting portions are created. As a result, advanced measures which improve the sealability are required in the connecting portions, or it is necessary to frequently perform maintenance.

The invention has been made in view of the above problems, and aims at easily improving sealability inside a housing in a turbo compressor.

SUMMARY OF THE INVENTION

In order to achieve the above object, the following means are adopted in the turbo compressor of the invention. That is, a turbo compressor comprising: a motor; an impeller which is rotationally driven as the rotative power of the motor is transmitted to the impeller; a gear unit which transmits the rotative power of the motor to the impeller; and an oil tank to which lubricant supplied to the gear unit is at least recovered, wherein the oil tank is a portion of a closed space formed by at least one of a motor housing surrounding the motor and an impeller housing surrounding the impeller.

In the turbo compressor of the invention having such a feature, the oil tank is comprised of a portion of a closed space formed by at least one of a motor housing surrounding the motor and an impeller housing surrounding the impeller.

In addition, in the invention, the "portion of a closed space" is not limited in size, number, and form, and may mean all closed spaces. Additionally, the size or portion of the housing to be used for the oil tank can also be selected if needed.

Additionally, in the turbo compressor of the invention, a configuration in which the oil tank is a space formed by the motor housing, and is connected to a space, which houses the gear unit, formed by the motor housing and the impeller housing is preferably adopted.

Additionally, in the turbo compressor of the invention, a configuration in which the oil tank is a space formed by the impeller housing, and is connected to a space, which houses the gear unit, formed by the motor housing and the impeller housing is preferably adopted.

Additionally, in the turbo compressor of the invention, a configuration in which the oil tank is a lower portion of a closed space, which houses the gear unit, formed by the motor housing and the impeller housing is preferably adopted.

Additionally, in the turbo compressor of the invention, a configuration further including a partition plate, which suppresses entry of lubricant mist from the oil tank to an upper portion of the closed space which houses the gear unit, between the upper portion and the oil tank that is the lower portion of the closed space is preferably adopted.

Next, the refrigerator of the invention relates to a refrigerator including a condenser which cools and liquefies a compressed refrigerant, an evaporator which evaporates the liquefied refrigerant and deprives vaporization heat from an object to be cooled, thereby cooling the object to be cooled, and a compressor which compresses the refrigerant evaporated in the evaporator and supplies the refrigerant to the condenser. This refrigerator includes the turbo compressor of the present invention as the compressor.

In the turbo refrigerator of the invention having such a feature, similarly to the turbo compressor of the invention, the oil tank is comprised of a portion of a closed space formed using at least one of a motor housing surrounding the motor and an impeller housing surrounding the impeller.

According to the invention, the oil tank is comprised of a portion of a closed space formed by at least one of a motor housing surrounding the motor and an impeller housing surrounding the impeller.

For this reason, it is not necessary to provide an oil tank separately from a housing surrounding the motor or impeller, and a connecting portion of the housings also becomes unnecessary.

Accordingly, according to the invention, in the turbo compressor, it is possible to easily improve sealability inside the housings.

DETAILED DESCRIPTION OF THE INVENTION

Hereinafter, one embodiment of a turbo compressor and a refrigerator according to the invention will be described with reference to the drawings. In addition, scales of individual members in the following drawings are appropriately changed so that each member can have a recognizable size. The invention is not limited only to embodiments discussed below, and for example, additions, alternations, and omissions of number, position, and size may be made.

(First Embodiment)

Figure 1:
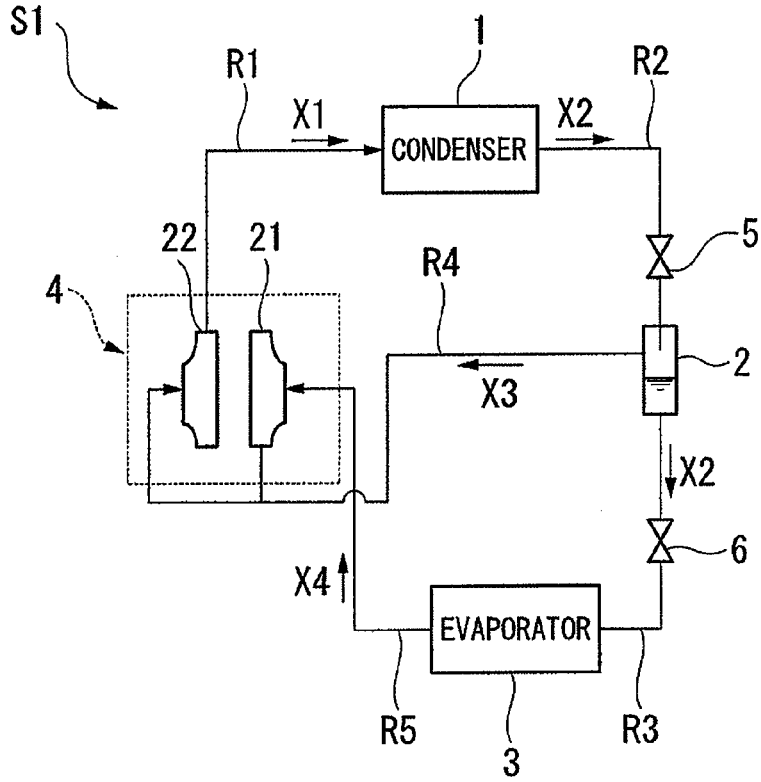
FIG. 1 is a block diagram showing a schematic configuration of a turbo refrigerator in a first embodiment of the invention.

FIG. 1 is a block diagram showing a schematic configuration of a turbo refrigerator S1 (refrigerator) in this embodiment.

The turbo refrigerator S1 in this embodiment is installed in buildings or factories in order to generate, for example, cooling water for air conditioning. As shown in FIG. 1, the turbo refrigerator includes a condenser 1, an economizer 2, an evaporator 3, and a turbo compressor 4.

The condenser 1 is supplied with a compressed refrigerant gas X1 that is a refrigerant (fluid) compressed in a gaseous state, and cools and liquefies the compressed refrigerant gas X1 to generate a refrigerant liquid X2. The condenser 1, as shown in FIG. 1, is connected to the turbo compressor 4 via a flow path R1 through which the compressed refrigerant gas X1 flows, and is connected to the economizer 2 via a flow path R2 through which the refrigerant liquid X2 flows. In addition, an expansion valve 5 for decompressing the refrigerant liquid X2 is installed in the flow path R2.

The economizer 2 temporarily stores the refrigerant liquid X2 decompressed in the expansion valve 5. The economizer 2 is connected to the evaporator 3 via a flow path R3 through which the refrigerant liquid X2 flows into the evaporator 3, and is connected to the turbo compressor 4 via a flow path R4 through which a gaseous refrigerant X3 generated in the economizer 2 flows into the turbo compressor 4. In addition, an expansion valve 6 for further decompressing the refrigerant liquid X2 is installed in the flow path R3. Additionally, the flow path R4 is connected to the turbo compressor 4 so as to supply the gaseous refrigerant X3 to a second compression stage 22 (which will be described later) included in the turbo compressor 4.

The evaporator 3 evaporates the refrigerant liquid X2 to remove vaporization heat from a cooling object, such as water, thereby cooling an object to be cooled. The evaporator 3 is connected to the turbo compressor 4 via a flow path R5 through which a refrigerant gas X4, which is generated by the evaporation of the refrigerant liquid X2, flows. In addition, the flow path R5 is connected to a first compression stage 21 (which will be described later) included in the turbo compressor 4.

The turbo compressor 4 compresses the refrigerant gas X4 and the gaseous refrigerant X3 to generate the compressed refrigerant gas X1.

The turbo compressor 4 is connected to the condenser 1 via the flow path R1 through which the compressed refrigerant gas X1 flows as described above, and is connected to the evaporator 3 via the flow path R5 through which the refrigerant gas X4 flows.

In the turbo refrigerator S1 configured in this way, the compressed refrigerant gas X1 supplied to the condenser 1 via the flow path R1 is cooled and liquefied into the refrigerant liquid X2 by the condenser 1.

When the refrigerant liquid X2 is supplied to the economizer 2 via the flow path R2, the refrigerant fluid is decompressed by the expansion valve 5. In this decompressed state, the refrigerant fluid is temporarily stored in the economizer 2. Thereafter, when the refrigerant fluid is supplied to the evaporator 3 via the flow path R3, the refrigerant fluid is further decompressed by the expansion valve 6, and is supplied to the evaporator 3 in the decompressed state.

The refrigerant liquid X2 supplied to the evaporator 3 is evaporated into the refrigerant gas X4 by the evaporator 3, and is supplied to the turbo compressor 4 via the flow path R5.

The refrigerant gas X4 supplied to the turbo compressor 4 is compressed into the compressed refrigerant gas X1 by the turbo compressor 4, and is supplied again to the condenser 1 via the flow path R1.

In addition, the gaseous refrigerant X3 generated when the refrigerant liquid X2 is stored in the economizer 2 is supplied to the turbo compressor 4 via the flow path R4, is compressed along with the refrigerant gas X4, and is supplied to the condenser 1 via the flow path R1 as the compressed refrigerant gas X1.

In such a turbo refrigerator S1, when the refrigerant liquid X2 is evaporated in the evaporator 3, vaporization heat is removed from an object to be cooled, thereby cooling or refrigerating the object to be cooled.

Subsequently, the turbo compressor 4 that is a characterizing portion of this embodiment will be described in more detail.

Figure 2:
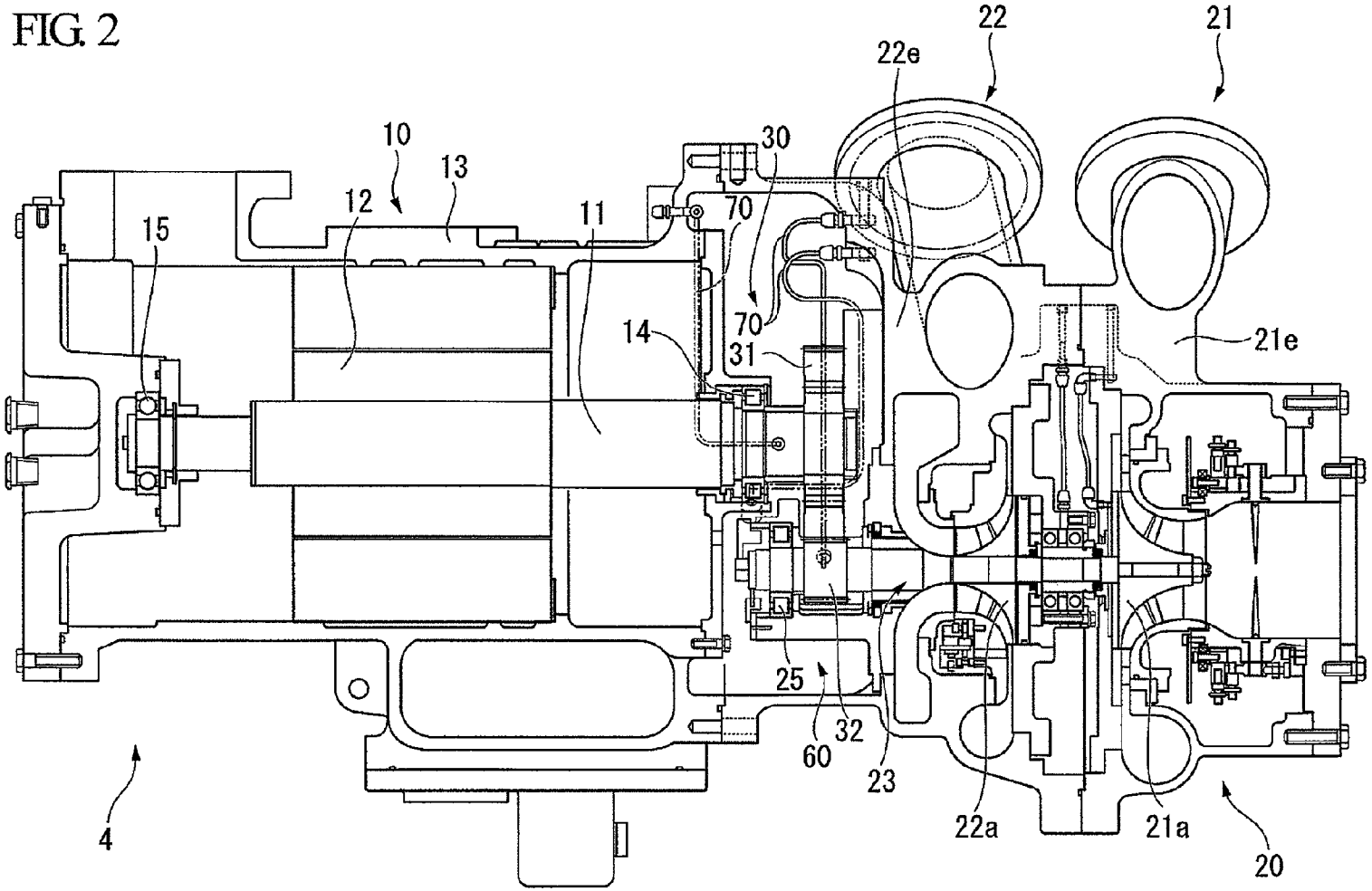
FIG. 2 is a horizontal sectional view of a turbo compressor included in the turbo refrigerator in the first embodiment of the invention.
Figure 3:
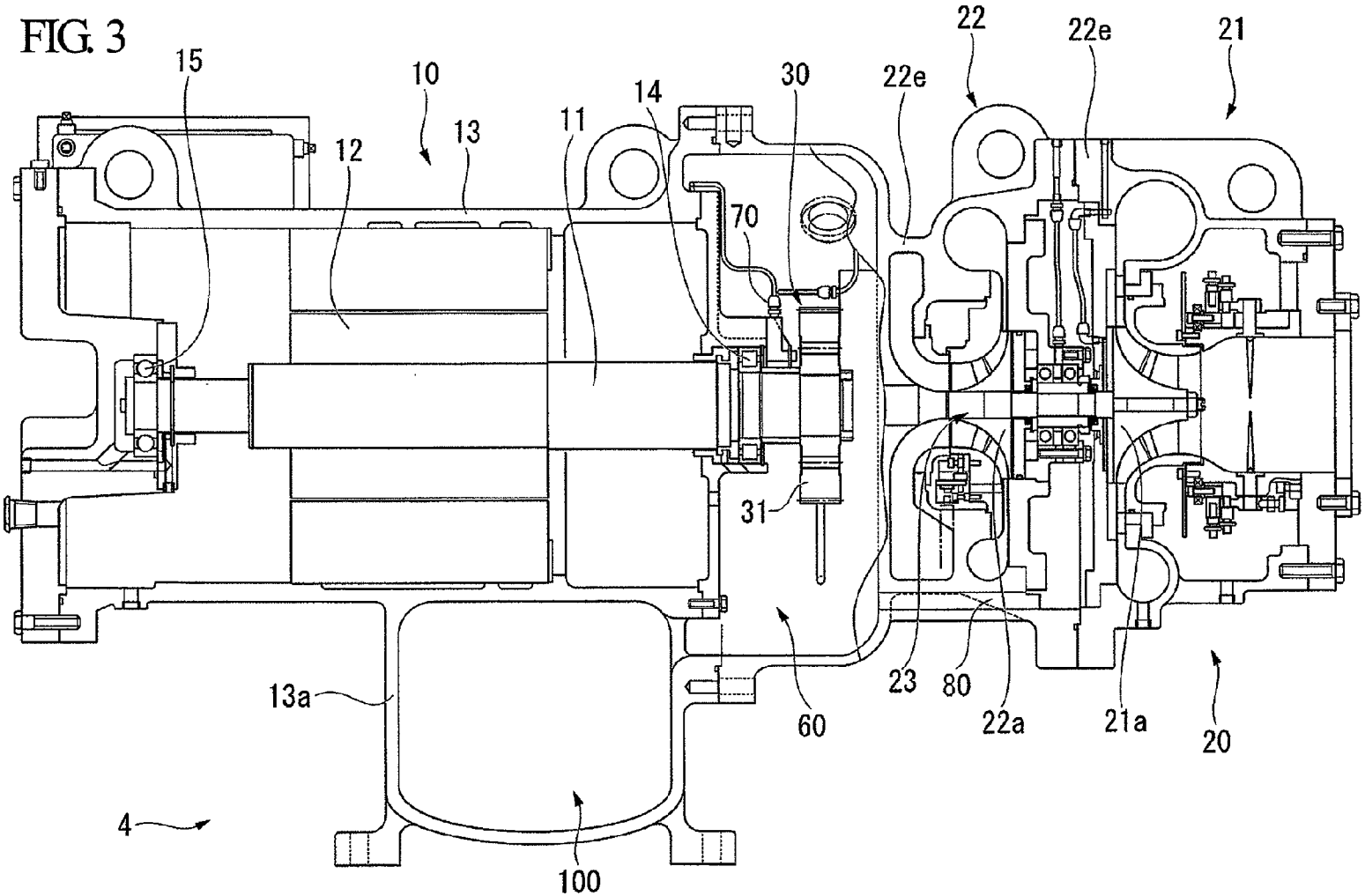
FIG. 3 is a vertical sectional view of the turbo compressor included in the turbo refrigerator in the first embodiment of the invention.
Figure 4:
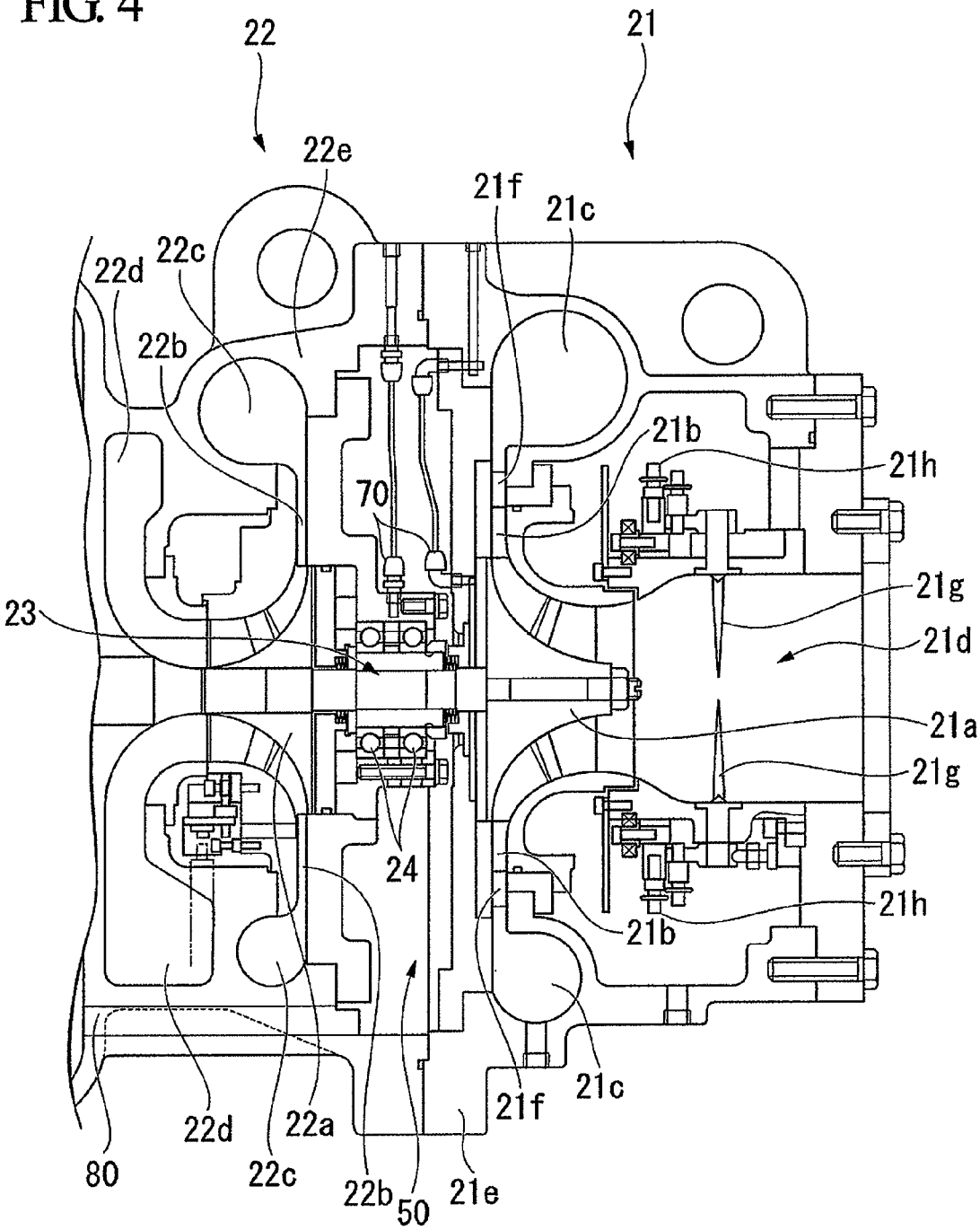
FIG. 4 is an enlarged view of essential parts of FIG. 3.

FIG. 2 is a horizontal sectional view of the turbo compressor 4. Additionally, FIG. 3 is a vertical sectional view of the turbo compressor 4. Additionally, FIG. 4 is an enlarged vertical sectional view of a compressor unit 20 included in the turbo compressor 4.

As shown in these drawings, the turbo compressor 4 in this embodiment includes a motor unit 10, a compressor unit 20, and a gear unit 30.

The motor unit 10 includes a motor 12 which has an output shaft 11 and serves as a driving source for driving the compressor unit 20, and a motor housing 13 which surrounds the motor 12 and supports the motor 12.

In addition, the output shaft 11 of the motor 12 is rotatably supported by a first bearing 14 and a second bearing 15 which are fixed to the motor housing 13.

Additionally, the motor housing 13 includes a leg portion 13*a* which supports the turbo compressor 4.

In the turbo compressor 4 in this embodiment, the inside of the leg portion 13*a* is formed in a hollow shape, and is used as an oil tank 100 where lubricant supplied to sliding parts of the turbo compressor 4 is recovered and stored.

That is, in the turbo compressor 4 in this embodiment, a space to be formed by the motor housing 13 is used as the oil tank 100.

The compression unit 20 includes the first compression stage 21 where the refrigerant gas X4 (refer to FIG. 1) is sucked and compressed, and the second compression stage 22 where the refrigerant gas X4 compressed in the first compression stage 21 is further compressed and is discharged as compressed refrigerant gas X1 (refer to FIG. 1).

The first compression stage 21 includes a first impeller 21*a*, a first diffuser 21*b*, a first scroll chamber 21*c*, and a suction port 21*d*. The first impeller 21*a* gives velocity energy to the refrigerant gas X4 to be supplied from a thrust direction (axial direction), and discharges the refrigerant gas in a radial direction (direction perpendicular to the axis). The first diffuser 21*b* converts the velocity energy, which is given to the refrigerant gas X4 by the first impeller 21*a*, into pressure energy, thereby compressing the refrigerant gas. The first scroll chamber 21*c* guides the refrigerant gas X4 compressed by the first diffuser 21*b* to the outside of the first compression stage 21. The suction port 21*d* allows the refrigerant gas X4 to be sucked therethrough and supplied to the first impeller 21*a*.

In addition, the first diffuser 21*b*, the first scroll chamber 21*c*, and a portion of the suction port 21*d* are formed by a first housing 21*e* (impeller housing) surrounding the first impeller 21*a*.

The first impeller 21*a* is fixed to a rotation shaft 23, and is rotationally driven as the rotation shaft 23 has rotative power transmitted thereto from the output shaft 11 of the motor 12 and is rotated.

Additionally, a plurality of inlet guide vanes 21*g* for adjusting the suction capacity of the first compression stage 21 is installed in the suction port 21*d* of the first compression stage 21.

Each inlet guide vane 21*g* is made rotatable by a driving mechanism 21*h* fixed to the first housing 21*e* so that its apparent area from a flow direction of the refrigerant gas X4 can be changed.

The second compression stage 22 includes a second impeller 22*a*, a second diffuser 22*b*, a second scroll chamber 22*c*, and an introducing scroll chamber 22*d*.

The second impeller 22*a* gives velocity energy to the refrigerant gas X4 which is compressed in the first compression stage 21 and supplied from the thrust direction, and discharges the refrigerant gas in the radial direction. The second diffuser 22*b* converts the velocity energy, which is given to the refrigerant gas X4 by the second impeller 22*a*, into pressure energy, thereby compressing the refrigerant gas and discharging it as the compressed refrigerant gas X1. The second scroll chamber 22*c* guides the compressed refrigerant gas X1 discharged from the second diffuser 22*b* to the outside of the second compression stage 22. The introducing scroll chamber 22*d* guides the refrigerant gas X4 compressed in the first compression stage 21 to the second impeller 22*a*.

In addition, the second diffuser 22*b*, the second scroll chamber 22*c*, and a portion of the introducing scroll chamber 22*d* are formed by a second housing 22*e* (impeller housing) surrounding the second impeller 22*a*.

The second impeller 22*a* is fixed to the rotation shaft 23 so as to face the first impeller 21 back to back and is rotationally driven as the rotation shaft 23 has rotative power transmitted thereto from the output shaft 11 of the motor 12 and is rotated.

The second scroll chamber 22*c* is connected to the flow path R1 for supplying the compressed refrigerant gas X1 to the condenser 1, and supplies the compressed refrigerant gas X1 drawn from the second compression stage 22 to the flow path R1.

In addition, the first scroll chamber 21*c* of the first compression stage 21 and the introducing scroll chamber 22*d* of the second compression stage 22 are connected together via an external pipe (not shown) which is provided separately from the first compression stage 21 and the second compression stage 22, and the refrigerant gas X4 compressed in the first compression stage 21 is supplied to the second compression stage 22 via the external pipe. The aforementioned flow path R4 (refer to FIG. 1) is connected to this external pipe, and the gaseous refrigerant X3 generated in the economizer 2 is supplied to the second compression stage 22 via the external pipe.

Additionally, the rotation shaft 23 is rotatably supported by a third bearing 24 fixed to the second housing 22*e* of the second compression stage 22, and a fourth bearing 25 fixed to the second housing 22*e* on the side of the motor unit 10, in a space 50 between the first compression stage 21 and the second compression stage 22.

The gear unit 30 is for transmitting the rotative power of the output shaft 11 of the motor 12 to the rotation shaft 23, and is housed in a space 60 formed by the motor housing 13 of the motor unit 10, and the second housing 22*e* of the compressor unit 20.

The gear unit 30 is comprised of a large-diameter gear 31 fixed to the output shaft 11 of the motor 12, and a small-diameter gear 32 which is fixed to the rotation shaft 23, and meshes with the large-diameter gear 31. The rotative power of the output shaft 11 of the motor 12 is transmitted to the rotation shaft 23 so that the rotation number of the rotation shaft 23 may increase with an increase in the rotation number of the output shaft 11.

Additionally, the turbo compressor 4 includes a lubricant-supplying device 70 which supplies lubricant stored in the oil tank 100 to a plurality of sliding parts, such as bearings (the first bearing 14, the second bearing 15, the third bearing 24, and the fourth bearing 25), parts between an impeller (the first impeller 21*a*, or the second impeller 22*a*) and a housing (the first housing 21*e* or the second housing 22*e*), and the gear unit 30. In the drawing, only a portion of the lubricant-supplying device 70 is shown.

In addition, the space 50 where the third bearing 24 is arranged and the space 60 where the gear unit 30 is housed are connected together by a through-hole 80 formed in the second housing 22*e*, and the space 60 and the oil tank 100 are connected together. For this reason, the lubricant which is supplied to spaces 50 and 60, and flows down from the sliding parts in the spaces is recovered to the oil tank 100.

That is, in the turbo compressor 4 in this embodiment, a space which is formed by the motor housing 13 and is connected to the space 60, which houses the gear unit 30 and is formed by the motor housing 13 and the second housing 22*e* (impeller housing), is used as the oil tank 100.

In the turbo compressor 4 in this embodiment with such a configuration, first, lubricant is supplied to respective sliding parts of the turbo compressor 4 from the oil tank 40 by the lubricant-supplying device 70, and then, the motor 12 is driven. Then, the rotative power of the output shaft 11 of the motor 12 is transmitted to the rotation shaft 23 via the gear unit 30, and thereby, the first impeller 21*a* and the second impeller 22*a* of the compressor unit 20 are rotationally driven.

When the first impeller 21*a* is rotationally driven, the suction port 21*d* of the first compression stage 21 is in a negative pressure state, and the refrigerant gas X4 from the flow path R5 flows into the first compression stage 21 via the suction port 21*d*.

The refrigerant gas X4 which has flowed into the inside of the first compression stage 21 flows into the first impeller 21*a* from the thrust direction, and the refrigerant gas has velocity energy given thereto by the first impeller 21*a*, and is discharged in the radial direction.

The refrigerant gas X4 discharged from the first impeller 21*a* is compressed as velocity energy is converted into pressure energy by the first diffuser 21*b*.

The refrigerant gas X4 discharged from the first diffuser 21*b* is guided to the outside of the first compression stage 21 via the first scroll chamber 21*c*.

Then, the refrigerant gas X4 guided to the outside of the first compression stage 21 is supplied to the second compression stage 22 via the external pipe.

The refrigerant gas X4 supplied to the second compression stage 22 flows into the second impeller 22*a* from the thrust direction via the introducing scroll chamber 22*d*, and the refrigerant gas has velocity energy given thereto by the second impeller 22*a*, and is discharged in the radial direction.

The refrigerant gas X4 discharged from the second impeller 22*a* is further compressed into the compressed refrigerant gas X1 as velocity energy is converted into pressure energy by the second diffuser 22*b*.

The compressed refrigerant gas X1 discharged from the second diffuser 22*b* is guided to the outside of the second compression stage 22 via the second scroll chamber 22*c*.

Then, the compressed refrigerant gas X1 guided to the outside of the second compression stage 22 is supplied to the condenser 1 via the flow path R1.

In the turbo compressor 4 in this embodiment as described above, the oil tank 100 is formed as a portion of a closed space formed by the motor housing 13 surrounding the motor 12. For this reason, it is not necessary to provide an oil tank separately from housings (the motor housing 13, the first housing 21*e*, and the second housing 22*e*), and a connecting portion of the housings and the oil tank prepared separately from the housing also becomes unnecessary.

Accordingly, according to the turbo compressor 4 in this embodiment, in the turbo compressor, it is possible to easily improve sealability inside the housings.

Also, the turbo refrigerator S1 in this embodiment includes the turbo compressor 4 whose sealability inside the housings is improved easily.

For this reason, in the turbo refrigerator S1 in this embodiment, it is possible to improve the sealability of the turbo compressor 4 without increasing manufacturing cost or maintenance cost.

(Second Embodiment)

Next, a second embodiment of the invention will be described. In addition, in the second embodiment, description of the same portions as those in the first embodiment is omitted or simplified.

Figure 5:
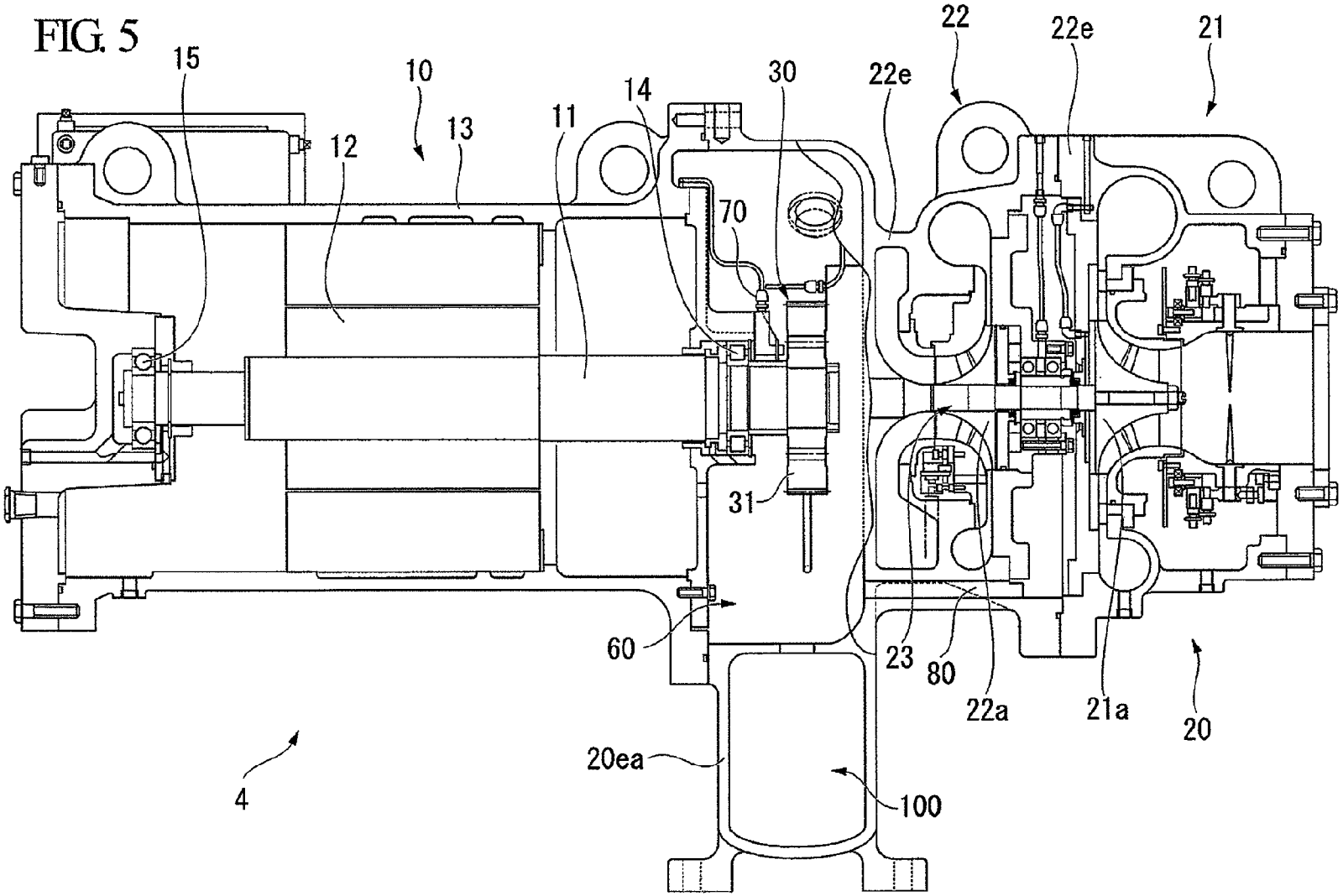
FIG. 5 is a vertical sectional view of the turbo compressor included in the turbo refrigerator in a second embodiment of the invention.

FIG. 5 is a vertical sectional view of the turbo compressor 4 in this embodiment. As shown in this drawing, in the turbo compressor 4 in this embodiment, the second housing 22*e* that is an impeller housing includes a leg portion 22*ea* which supports the turbo compressor 4. In the turbo compressor 4 in this embodiment, the inside of the leg portion 22*ea* is hollow, and is used as the oil tank 100. Also, the space 60, which is formed by the motor housing 13 and the second housing 22*e* (impeller housing) and houses the gear unit 30, and the oil tank 100 are connected together.

That is, in the turbo compressor 4 in this embodiment, a space which is formed by the second housing 22*e* and is connected to the space 60, which houses the gear unit 30 and is formed by the motor housing 13 and the second housing 22*e* (impeller housing), is used as the oil tank 100. Since the connection is made by holes or the like, the lubricant which has flowed down from sliding parts can pass through the holes, and can be recovered to the oil tank 100.

In the turbo compressor 4 in this embodiment as described above, the oil tank 100 is formed as a portion of a closed space formed by the second housing 22*e* surrounding the second impeller 22*a*. For this reason, it is not necessary to provide an oil tank separately from housings (the motor housing 13, the first housing 21*e*, and the second housing 22*e*), and a connecting portion of the housings and the oil tank which is prepared separately from the housing also becomes unnecessary.

Accordingly, according to the turbo compressor 4 in this embodiment, in the turbo compressor, it is possible to easily improve sealability inside the housings.

(Third Embodiment)

Next, a third embodiment of the invention will be described. In addition, in the third embodiment, description of the same portions as those in the first embodiment is omitted or simplified.

Figure 6:
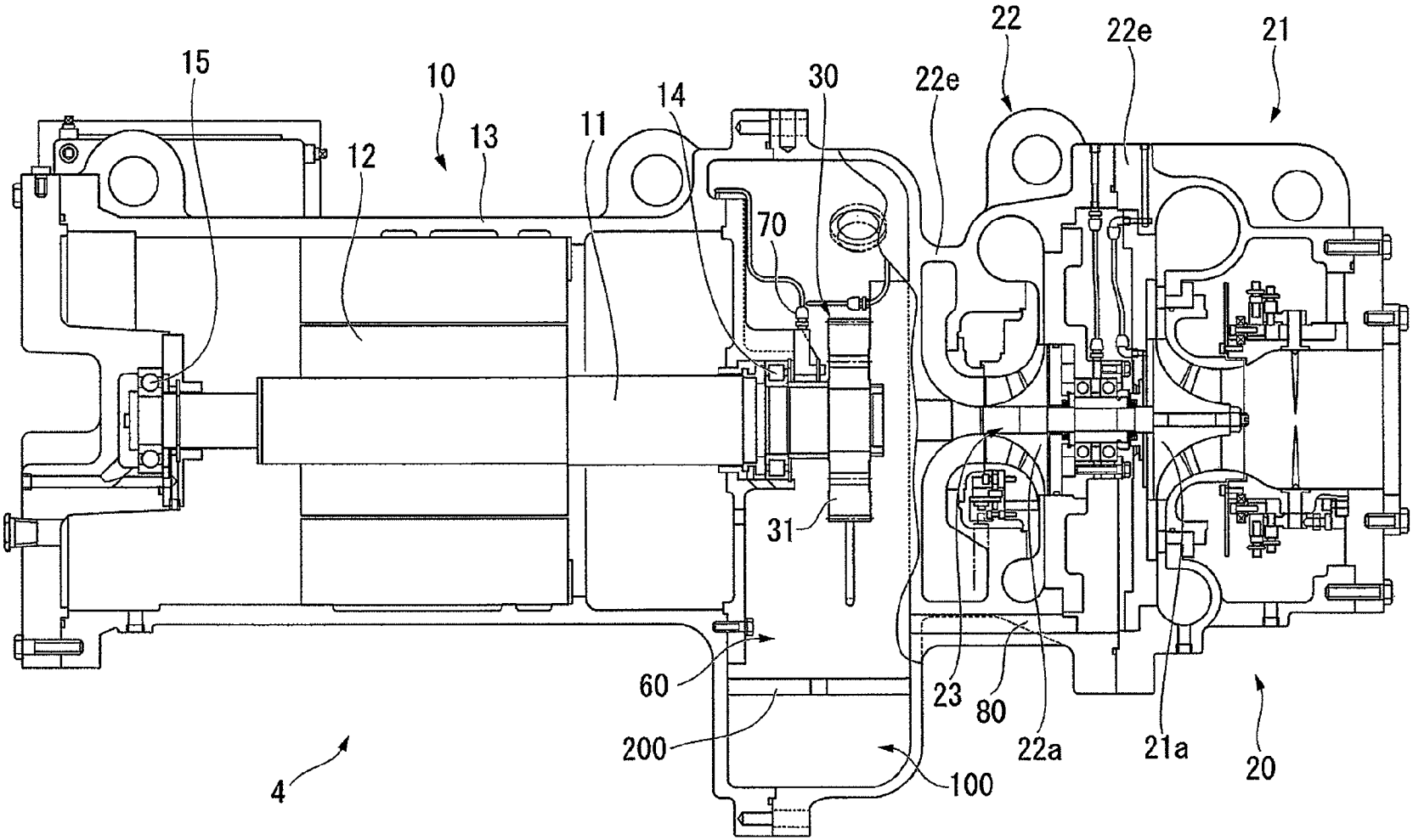
FIG. 6 is a vertical sectional view of the turbo compressor included in the turbo refrigerator in a third embodiment of the invention.

FIG. 6 is a vertical sectional view of the turbo compressor 4 in this embodiment. As shown in this drawing, in the turbo compressor 4 in this embodiment, a lower portion of the space 60 which houses the gear unit 30 formed by the motor housing 13 and the second housing 22*e* (impeller housing) is the oil tank 100.

In the turbo compressor 4 in this embodiment, a partition plate 200 which suppresses entry of lubricant mist from the oil tank 100 to an upper portion of a space which houses the gear unit 30 is installed between the upper portion and the oil tank 100 that is the lower portion of the space.

Since the partition plate 200 narrows a connection space between the oil tank 100 and its upper space, lubricant mist generated in the oil tank 100 can be prevented from being scattered to the upper portion. In addition, since connecting portions by holes or the like can be provided in such a partition plate 200 or in other portions, the lubricant which has flowed down from sliding parts can be reliably recovered to the oil tank 100 by installing such a partition plate 200.

In the turbo compressor 4 in this embodiment as described above, the oil tank 100 is formed as a portion of a closed space formed by the motor housing 13 surrounding the motor 12 and the second housing 22*e* surrounding the second impeller 22*a*. For this reason, it is not necessary to provide an oil tank separately from housings (the motor housing 13, the first housing 21*e*, and the second housing 22*e*), and a connecting portion of the housings and the oil tank which is prepared separately from the housings also becomes unnecessary.

Accordingly, according to the turbo compressor 4 in this embodiment, in the turbo compressor, it is possible to easily improve sealability inside the housings.

In addition, in the turbo compressor 4 in this embodiment, the leg portion which supports the turbo compressor 4 may be formed by the motor housing 13 and/or the second housing 22*e*, or the turbo compressor 4 may be supported by installing a leg portion separately.

Although the preferred embodiments of the turbo compressor and the refrigerator according to the invention have been described with reference to the accompanying drawings, it is needless to say that the invention is not limited to the above embodiments, and are only limited by the scope of appended claims. Various shapes or combinations of respective constituent members illustrated in the above-described embodiments are merely examples, and various changes may be made depending on design requirements or the like in so far as they depart from the spirit or scope of the present invention.

For example, the configuration including two compression stages (the first compression stage 21 and the second compression stage 22) has been described in the above first embodiment.

However, the invention is not limited thereto, and a configuration including a single compression stage or three or more compression stages may be adopted.

Additionally, it has been described in the above embodiments that the turbo refrigerator is installed in buildings or factories in order to generate cooling water for air conditioning.

However, the invention is not to be limited thereto, and can be applied to freezers or refrigerators for home use or business use, or air conditioners for home use.

Additionally, it has been described in the above first embodiment that the first impeller 21*a* included in the first compression stage 21 and the second impeller 22*a* included in the second compression stage 22 are made to face each other back to back.

However, the invention is not limited thereto, and may be configured so that the back of the first impeller 21*a* included in the first compression stage 21 and the back of the second impeller 22*a* included in the second compression stage 22 face the same direction.

Additionally, the turbo compressor in which the motor unit 10, the compression unit 20, and the gear unit 30 are provided respectively has been described in the first embodiment.

However, the invention is not limited thereto and for example, a configuration in which a motor is arranged between the first compression stage and the second compression stage may be adopted.

In any case, the turbo compressor of the invention can easily improve sealability inside the housing.

What is claimed is:

1. A turbo compressor comprising:

a motor;

an impeller which is rotationally driven as the rotative power of the motor is transmitted to the impeller;

a gear unit which transmits the rotative power of the motor to the impeller; and an oil tank to which lubricant supplied to the gear unit is at least recovered, wherein the oil tank is a portion of a closed space formed by at least one of a motor housing surrounding the motor and an impeller housing surrounding the impeller;

and the oil tank is configured such that a space in the oil tank and a space surrounding the gear unit are separated from each other and connected via an opening provided in the oil tank.

2. The turbo compressor according to claim 1, wherein the oil tank is a space formed by the motor housing, and is connected to a space, which houses the gear unit, formed by the motor housing and the impeller housing.

3. A refrigerator comprising:

a condenser which cools and liquefies a compressed refrigerant;

an evaporator which evaporates the liquefied refrigerant and deprives vaporization heat from an object to be cooled, thereby cooling the object to be cooled; and a compressor which compresses the refrigerant evaporated in the evaporator and supplies the refrigerant to the condenser, wherein the compressor is the turbo compressor according to claim 2.

4. The turbo compressor according to claim 1, wherein the oil tank is a space formed by the impeller housing, and is connected to a space, which houses the gear unit, formed by the motor housing and the impeller housing.

5. A refrigerator comprising:

a condenser which cools and liquefies a compressed refrigerant;

an evaporator which evaporates the liquefied refrigerant and deprives vaporization heat from an object to be cooled, thereby cooling the object to be cooled; and a compressor which compresses the refrigerant evaporated in the evaporator and supplies the refrigerant to the condenser, wherein the compressor is the turbo compressor according to claim 4.

6. The turbo compressor according to claim 1, wherein the oil tank is a lower portion of a closed space, which houses the gear unit, formed by the motor housing and the impeller housing.

7. The turbo compressor according to claim 6, further comprising a partition plate between an upper portion of the closed space, which houses the gear unit, and the lower portion, which is the oil tank, wherein the partition plate suppresses entry of lubricant mist from the oil tank to the upper portion.

8. A refrigerator comprising:

a condenser which cools and liquefies a compressed refrigerant;

an evaporator which evaporates the liquefied refrigerant and deprives vaporization heat from an object to be cooled, thereby cooling the object to be cooled; and a compressor which compresses the refrigerant evaporated in the evaporator and supplies the refrigerant to the condenser, wherein the compressor is the turbo compressor according to claim 7.

9. A refrigerator comprising:

a condenser which cools and liquefies a compressed refrigerant;

an evaporator which evaporates the liquefied refrigerant and deprives vaporization heat from an object to be cooled, thereby cooling the object to be cooled; and a compressor which compresses the refrigerant evaporated in the evaporator and supplies the refrigerant to the condenser, wherein the compressor is the turbo compressor according to claim 6.

10. A refrigerator comprising:

a condenser which cools and liquefies a compressed refrigerant;

an evaporator which evaporates the liquefied refrigerant and deprives vaporization heat from an object to be cooled, thereby cooling the object to be cooled; and a compressor which compresses the refrigerant evaporated in the evaporator and supplies the refrigerant to the condenser, wherein the compressor is the turbo compressor according to claim 1.

11. The turbo compressor of claim 1, wherein the oil tank is one of a portion of a closed space formed by a motor housing surrounding the motor, a portion of a closed space formed by an impeller housing surrounding the impeller and a portion of a closed space formed by both the motor housing and the impeller housing.

12. A turbo compressor comprising:

a motor;

an impeller which is rotationally driven as the rotative power of the motor is transmitted to the impeller;

a gear unit which transmits the rotative power of the motor to the impeller; and an oil tank to which lubricant supplied to the gear unit is at least recovered, wherein the oil tank is a lower portion of a closed space, which houses the gear unit, formed by a motor housing surrounding the motor and an impeller housing surrounding the impeller; and the turbo compressor further comprises a partition plate between an upper portion of the closed space, which houses the gear unit, and the lower portion, which is the oil tank, wherein the partition plate suppresses entry of lubricant mist from the oil tank to the upper portion.

13. A refrigerator comprising:

a condenser which cools and liquefies a compressed refrigerant;

an evaporator which evaporates the liquefied refrigerant and deprives vaporization heat from an object to be cooled, thereby cooling the object to be cooled; and a compressor which compresses the refrigerant evaporated in the evaporator and supplies the refrigerant to the condenser, wherein the compressor is the turbo compressor according to claim 12.

* * * * *